United States Patent [19]

Gebel et al.

[11] 4,334,133

[45] Jun. 8, 1982

[54] CONTACT ARRANGEMENT FOR VACUUM SWITCHES

[75] Inventors: Rudolf Gebel, Erlangen; Gerhard Peche, Berlin; Heinrich Schindler; Jürgen-Dietrich Welly, both of Erlangen, all of Fed. Rep. of Germany

[73] Assignee: Siemens Aktiengesellschaft, Munich, Fed. Rep. of Germany

[21] Appl. No.: 132,865

[22] Filed: Mar. 24, 1980

[30] Foreign Application Priority Data

Mar. 20, 1979 [DE] Fed. Rep. of Germany ..... 2912823
Nov. 26, 1979 [DE] Fed. Rep. of Germany ..... 2947562

[51] Int. Cl.[3] ..... H01H 1/06
[52] U.S. Cl. ..... 200/279; 200/144 B; 200/267
[58] Field of Search ..... 200/239, 245, 267, 275, 200/279, 144 B

[56] References Cited

U.S. PATENT DOCUMENTS

| | | | |
|---|---|---|---|
| 1,132,094 | 3/1915 | Hosford | 200/267 |
| 2,580,910 | 1/1952 | Harman | 200/279 |
| 3,089,936 | 5/1963 | Smith | 200/279 |
| 3,185,799 | 5/1965 | Greenwood et al. | 200/144 B |
| 3,327,081 | 6/1967 | Pflanz | 200/275 |
| 3,546,407 | 12/1970 | Schneider | 200/144 B |
| 3,622,724 | 11/1971 | Sofianek | 200/144 B |

FOREIGN PATENT DOCUMENTS

| | | | |
|---|---|---|---|
| 964405 | 7/1964 | United Kingdom | 200/144 B |

*Primary Examiner*—John W. Shepperd
*Attorney, Agent, or Firm*—Kenyon & Kenyon

[57] ABSTRACT

A contact arrangement for vacuum switches with coaxially arranged cup contacts, the slotted contact carrier of which is provided with a contact ring, in which, the exposed surface of the contact ring is provided with bevels extending radially inward and outward and the contact ring and/or the contact carrier contain an annular zone with an electric conductivity which is substantially reduced in comparison with the material of the contact carrier.

22 Claims, 6 Drawing Figures

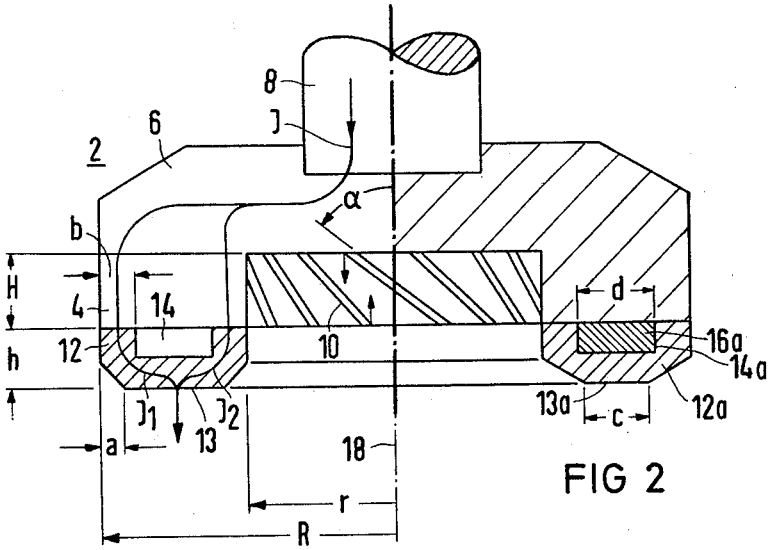
FIG 1
FIG 2
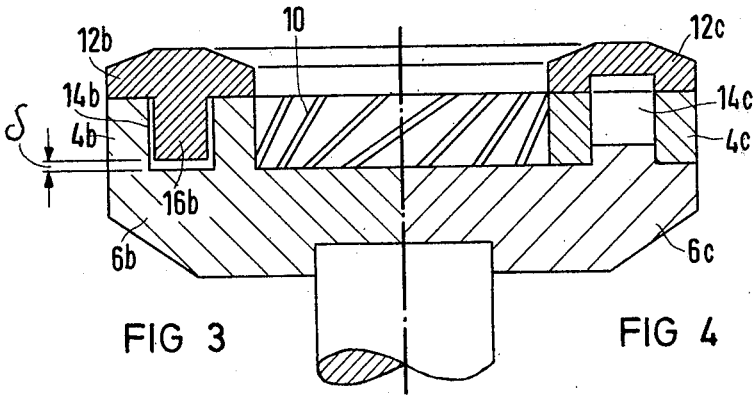
FIG 3
FIG 4

CONTACT ARRANGEMENT FOR VACUUM SWITCHES

BACKGROUND OF THE INVENTION

This invention relates to a contact arrangement for vacuum switches in general and more particularly to a contact arrangement with cup contacts having improved arc stabilization.

A contact arrangement for vacuum switches with cup contacts which are arranged coaxially with respect to each other and the slotted contact carrier of which is provided with a closed contact ring, the end face of which forms the contact surface is known in the art.

The cup contacts, which are coaxially disposed opposite each other, each form a hollow body of revolution, the bottom of which is connected to a current lead and the rim of which forms the annular contact surface. The contact carriers of both contacts are provided with inclined slots arranged in opposite directions, which divide the contact carrier into individual segments. These segments, together with the arc drawn after the contacts are opened, form a current loop, the Lorentz force of which makes the arc rotate between the contacts. The inclination of the slots relative to the axis of the cup contact is chosen large enough so that the slots overlap in the contact carrier in the azimuthal direction. The bottom of the cup contact can also be provided with slots (German Pat. No. 1 196 751).

One known embodiment of a contact arrangement for vacuum switches contains cup contacts which are provided with a washer-like contact overlay. The two contacts are arranged concentrically to each other in such a manner that an inner contact is surrounded by the contact walls of the outer contact and their rims point axially in the same direction. In the case of the outer contact, the contact overlay is arranged inside the cup, while in the case of the inner contact, the current lead is arranged in the cup and the bottom of the contact is provided with the contact overlay. The contact overlays are therefore opposite each other in a central part of the two contacts. An arc drawn after the contacts are lifted is to be driven away from the contact surfaces toward the walls of the cup contacts, which serve as burn-off areas of the contacts. To accomplish this, a flat intermediate layer of a material having a higher electric resistance is embedded between the respective contact overlay and the current lead, and is arranged as close to the current lead as possible in the bottom of the cup contacts (German Offenlegungsschrift No. 25 46 376).

It is now an object of the present invention to force, in a contact arrangement with cup contacts, the rims of which form the respective contact surfaces, a current distribution in each of the contacts, between the current leads and the annular contact surface, such that the bases of a rotating arc drawn between the contacts are stabilized between the contact surfaces. In particular, a force component on the arc directed radially inward as well as outward is to be avoided.

SUMMARY OF THE INVENTION

According to the present invention, this problem is solved by providing the exposed surface of the contact ring with a bevel, extending both radially inward and outward and by providing an annular zone between on the contact surface of the contact ring and the contact carrier, i.e., zone in the contact ring and/or the part of the contact carrier adjoining the contact ring, which zone has an electric conductivity which is substantially reduced from that of the material of the contact carrier. This zone of low electric conductivity causes a branching of the current conduction from the contact carrier to the contact surface of the contact ring, which current conduction has current components which run substantially radially within the contact ring. The magnetic fields of these radial current components exert respective Lorentz forces on the arc, which are directed radially toward the center of the strip-shaped contact surface, and stabilization of the arc discharge on the contact ring is achieved. The arc can therefore travel neither into the recess of the cup contact nor toward the outer rim.

The oppositely arranged inclined slotting of the contact carriers of the mutually coaxial contacts produces a component of the Lorentz force which is directed aximuthally to the contact rings and drives the arc. It rotates on a circular track between the contact surfaces.

The bevel of the contact ring prevents the arc from being fired at a point of the contact surface at which the stabilizing effect cannot occur. In addition, an increased contact pressure is obtained with this embodiment due to the reduced width of the contact surface relative to the width of the contact carrier.

To obtain the current displacing effect of the zone of low electrical conductivity on the current components, the electric resistance of the zone can preferably be twice as high and particularly, three times as high as the electric resistance of the contact carrier. A particularly simple and effective embodiment of the contact arrangement is obtained if the zone is designed as a recess which is evacuated together with the environment of the contact arrangement, for instance, within the quenching chamber of a vacuum switch.

The zone with increased electric resistance can also be obtained by incorporating, e.g., diffusing or alloying, supplementary material which increases the resistance into the contact material. Tin, bismuth or phosphorous as well as arsenic are suited for this purpose, for instance. To accomplish this, the surface of the contact ring facing the contact carrier can, for instance, be provided with an overlay of the resistance material, which is then melted or sintered into the contact ring. Subsequently, the overlay can be again removed from the surface of the contact ring.

The appropriately shaped resistance material can also be laid into the recess. This insert may consist of a ferromagnetic material, for instance, iron, which amplifies the stabilizing forces acting on the arc. The insert may also consist of an insulator, e.g., a ceramic body. In addition, metals with low electric conductivity such as chromium or also chrome-copper as well as cobalt can be used as the insert. Graphite is also suitable as the insert.

The insert can preferably be shaped so that a gap is generated in the path of the current at least approximately transversely to the direction of the current between the insert and the contact carrier or also between the insert and the contact ring. The size of this gap is preferably chosen at least as large as the axial component of the width of the slots of the contact carrier. In general, the gap width will not be substantially less than 0.2 mm.

In one particular embodiment of the contact arrangement, the surface of the contact carrier adjoining the contact ring is provided with a recess and the insert consists of the material of the contact ring. In this embodiment, the contact which extends into the recess of the contact carrier. The height of this extension can be made somewhat smaller than the depth of the recess. The mentioned gap is then formed between the end face of the extension and the bottom of the recess.

The contact ring consists of a material of high temperature resistance and high burn-off resistance as well as high mechanical strength. Such properties are exhibited, for instance, by sintered materials which contain chromium and copper as the essential components. In connection with a contact ring which consists of a metal impregnated metal matrix, for instance, a chromium-copper matrix, a material is preferably chosen for the contact carrier which consists, at least substantially, of the impregnating metal of the contact ring, for instance, copper. The contact ring with at least the adjoining part of the contact carrier can be made by so-called back-up casting, wherein first the contact ring and subsequently the carrier body are cast in a common operation. The insert can be inserted as a shaped body and can be enclosed by the casting material when it is poured, or, with appropriate design, can subsequently removed again. In this embodiment, for instance, the contact ring as well as the adjoining part of the contact carrier can be provided with a common recess. This common part is then fastened to the bottom of the contact, for instance, by soldering.

In a particular embodiment of the contact, the electric conductivity of the contact ring is substantially lower, preferably by at least a factor 3, than the conductivity of the contact carrier. This increase of the resistance of the contact ring in comparison to the contact carrier is obtained through the use of the chromium-copper matrix. Such an increase in the resistance is also obtained by an increased content of the contact ring of suitable additives, for instance, iron up to about 15% or cobalt up to about 20%, or also only by an addition of iron and cobalt.

BRIEF DESCRIPTION OF THE DRAWINGS

FIGS. 1 to 6 illustrate different respective designs of cup contacts according to the present invention in schematic cross section on both sides of the common axis of rotation. A portion of the cross section area in FIG. 1 is not shown hatched so as to not interfere with the clarity of presentation.

DETAILED DESCRIPTION OF THE INVENTION

Figure 5:
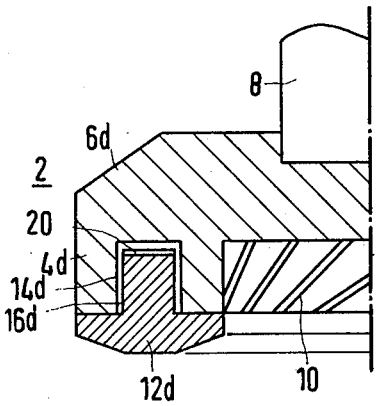

In the embodiment of the contact arrangement according to FIG. 1, a preferably shallow cup contact having an outside diameter of, for instance, 2R=75 mm and an inside diameter of 2r=45 mm is provided with a contact carrier 4, the height H of which is to be, for instance, 13 mm, and with a bottom part 6 having an electrical connecting conductor 8. The contact carrier 4 contains inclined slots 10, the angle of inclination to the axis of rotation 18 of which is preferably chosen so that the end faces of two respective segments produced between two slots do not overlap in the azimuthal direction. This is ensured if going vertically up, an adjoining slot is encountered starting from the end of one of the slots at the contact ring 12. Similarly, one meets the adjoining slot going vertically down, starting from the end of this slot at the bottom 6 of the contact, as is indicated in the figure by arrows, not specifically designated. It is assured with this inclination of the slots 10 that the current flowing through the segments produced always has a directional component which is inclined to the axis 18 and forms, with an arc drawn between the contacts and the current in the corresponding segment of the opposite contact, a current loop which produces an azimuthally directed Lorentz force on the arc and thereby makes the arc rotate between the contacts. With the inclination of the slots 10 given, at least one slot, not shown in the figure, in the contact carrier 4 always passes through the section plane.

The end faces of the contact carrier 4 are provided with a contact ring 12 of so-called contact meterial which is known to have high burn-off resistance as well as great mechanical strength, and may, for instance, be a sintered material containing chromium and copper. The height h of the contact ring 12 may be, for instance, 4 mm. The surface of the contact ring 12 facing the contact carrier 4 is provided with a circular recess 14 which represents an increased electric resistance for the current I, so that it is already divided in the contact carrier 4 into two components $I_1$ and $I_2$ which are directed in the contact ring 12, in the vicinity of its end face which forms the contact surface 13, substantially radially to the axis of rotation.

In the radial direction, the contact ring 12 is provided on both sides of the contact surface 13 with a bevel, not specifically designated. The bevel of the outer edge is made so that the radial distance a of the outer edge of the contact surface 13 from the outer wall of the contact carrier 4 is more than half of the distance b of the outer edge of the recess 14 from the outer wall of the contact carrier 4. The bevel on the inside of the contact ring 12 is made in similar fashion. With this design of the bevels of the contact 12, a radial current component of the sub-current $I_1$ as well as one such of the subcurrent $I_2$ is ensured, even if the arc is produced at the edge of the contact surface when the contacts are lifted.

However, in a special embodiment of the contact arrangement according to FIG. 2, the bevel is preferably chosen such that the radial width c of the contact surface 13*a* is at most as large as and, in particular, smaller than the radial width of the recess 14*a*. This results in an increased stabilizing effect on the arc due to larger radial current components. The edge of the contact surface has an additional stabilizing effect. The recess 14*a* is provided with an annular insert 16*a* of a material with an electric resistance which is larger than that of the material of the contact carrier 4*a*. It may consist, for instance, of electrically insulating material, preferably a ceramic material. In addition, graphite or also an annular body of metallic resistance material, for instance, chromium or iron, is suitable.

Instead of the recess 14*a* shown in FIG. 2 with a suitable insert 16*a* of resistance material, the zone with increased electric resistance can also be made without a recess by incorporating a material with increased electric resistance into the material of the contact ring 12*a* in this zone, for instance by diffusion or alloying. The material of the contact ring 12*a* in the zone with increase electric resistance or the material of the insert in this zone is preferably chosen so that the electric resistance in this zone is higher than the resistance of the carrier body 4 by at least a factor two.

In the embodiment according to FIG. 3, the end face of the contact carrier 4*a* facing the contact ring 12*a* is provided with a recess 14*b* which contains an annular insert 16*b*. The insert 16*b* is fastened to the contact ring 12*b* and can advantageously be integral therewith and can thus also consist of the same material. The height of the extension is preferably chosen somewhat smaller than the depth of the recess 14*b*, so that between the end face of the extension 16*b* and the bottom of the recess 14*b* a gap δ is created which permits a slight upsetting of the contact carrier 4*b*.

The contact arrangement shown in this embodiment is suitable, for instance, for a voltage of 12 kV and an operating current of about 1000 A and a nominal short circuit interrupting current of about 40,000 A. Such contacts are pressed together during operation with a correspondingly high contact pressure, for instance, F=4000 N, which causes a certain amount of elastic deformation of the contact carrier 4*b* and the bottom 6. This elastic deformation, first, reduces the gap between the insert 16*b* and the contact bottom 6*b* according to FIG. 3 and fills it out with increasing deformation of the contact carrier 4*b*, so that it then decreases the further deformation of the contact by the contact pressure F substantially. The width of the gap δ is limited to an amount, however, which is chosen so that the slots 10 are not completely closed with increasing deformation of the contact carrier 4*b*.

Under some conditions, the recess 14*b* in the embodiment of the contact according to FIG. 3 can also be provided with an insert which is fastened to the bottom of the recess 14*b*, in which case, an appropriate gap is created between this insert and the contact ring 12*b*.

According to FIG. 4, a recess 14*c* which extends into the contact carrier 4*c* as well as into the contact ring 12*c* can also be provided. The recess 14*c* is either evacuated with the contact arrangement or contains an insert not shown in the figure. This insert can also be designed so that a gap is created either in the contact ring or in the part of the recess of the contact carrier 4*c*, as is shown in FIG. 3.

A particularly simple method for manufacturing the contact comprises making the contact carrier 4*c* simultaneously with the impregnation of the matrix metal of the contact ring 12*c* by what is known as back-up casting. In back-up casting, the recess 14*c* is filled, for instance, in accordance with FIG. 4, with a formed body which is shaped so that it can be removed again after the casting of the carrier body 4*c*. The metal matrix of the contact ring 12*c*, for instance, chromium-copper, and the impregnating metal of the contact carrier, optionally with predetermined additions, are then firmly fused together. Subsequently, the contact carrier 4*c* with its end face consisting of two concentric ring areas is fastened to the bottom 6*c* of the contact, for instance, soldered with silver solder. For centering this common body formed of the contact ring 12*c* and the contact carrier 4*c*, the bottom 6*c* may be provided with a corresponding annular extension, not specifically designated in the figure, the radial width of which is equal to the radial width of the recess 14*c*.

In some cases it may be advisable to use the mentioned formed body as an insert for the recess 14*c*. It then can be enclosed by the material of the contact carrier 4*c* and by the contact ring 12*c*.

The slots 10 may also extend through at least part of the bottom 6*c*.

In the embodiment of the contact arrangement of FIG. 5, the surface of the contact carrier 4*d* facing the contact ring 12*d* is provided, corresponding to the design according to FIG. 3, with a recess 14*d* which divides the current to be switched into current paths, the components of which run substantially radially in the contact ring. The recess 14*d* is provided with an insert 16*d*. This insert 16*d* is formed by an annular flange-like extension of the contact ring 12*d*. It extends into the recess 14 in such a manner that its exposed end face still has some spacing from the bottom 6*d* of the cup contact 2. In the embodiment shown, the recess 14*d* has about the same depth as the contact carrier 4*d*. The depth of the recess 14*d* and thereby, the height of the insert 16*d* can also be chosen, if desired, substantially smaller than the height of the contact carrier 4*d*.

With increasing deformation, due to the large contact pressures with the switch closed, the gap shown in FIG. 5, between the end face of the insert 16*d* and the contact bottom 6*d*, can be closed, so that the end face then bears directly against the contact bottom 6*d*. In that case, the passage of current from the contact bottom 6*d* to the insert 16*d* is prevented by an electrically insulating intermediate layer 20. If the insert 16*d* consists of the same material as the contact ring 12*d*, the intermediate layer 20 can consist of an electrically insulating surface layer, preferably a metal oxide. In connection with a contact ring 12*d* which contains chromium and copper as essential components, this surface layer may consist, for instance, of chromium oxide.

Under these circumstances, it may be advantageous to also provide the lateral surfaces of the insert 16*d* with an electrically insulating surface layer, so that there, too, the passage of current to the insert 16*d* can be prevented.

Figure 6:
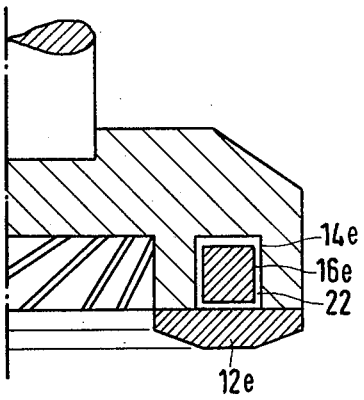

In the embodiment according to FIG. 6, the insert 16*e* consists of an inserted ring 16*e* of electrically poorly conducting material, for instance, iron. In this embodiment, for instance, the entire surface of the annular insert 16*e* can be provided with an electrically insulating coating 22. In some cases it may be sufficient to provide only the surface adjacent to the contact ring 12*e* of the insert 16*e* with an electrically insulating coating or with a separate intermediate layer which prevents the passage of current from the insert 16*e* to the contact ring 12*e*.

What is claimed is:

1. In a contact arrangement for vacuum switches with cup contacts which are arranged coaxially to each other, each comprising a slotted contact carrier which is provided with a closed contact ring, the end face of which forms a contact surface, the improvement comprising:

(a) bevels formed on the exposed surface of the contact ring extending radially inward and outward leaving an annular flat portion of reduced width on the face of the contact ring to form the contact surface, and;

(b) an annular zone of substantially reduced conductivity as compared to the material of the contact carrier between the contact ring and the contact carrier in an area which is adjacent the annular flat portion of said contact surface whereby current will flow from said contact carrier, through the portion of said contact ring containing said bevels to said flat contact surface to result in magnetic forces which tend to stabilize the arc.

2. The improvement according to claim 1, wherein the width of said zone is larger in the radial direction than the width of the contact surface.

3. The improvement according to claim 1 wherein said zone comprises a recess.

4. The improvement according to claim 3, wherein said contact carrier is provided with the recess and wherein said insert is fastened to said contact ring.

5. The improvement according to claim 4, wherein said insert consists of the material of the contact ring.

6. The improvement according to claim 5, wherein said insert forms a common part with the contact ring.

7. The improvement according to claim 5 wherein said insert is spaced from at least one boundry of said recess with a gap.

8. The improvement according to claim 7, wherein the width of said gap is smaller than the axial component of the width of the slots of the contact carrier.

9. The improvement according to claim 7 wherein the width of said gap is at least 0.2 mm.

10. The improvement according to claims 1 wherein said zone comprises an annular recess having an insert disposed therein.

11. The improvement according to claim 10, wherein said insert consists of ferromagnetic material.

12. The improvement according to claim 10, wherein said insert consists of an insulator.

13. The improvement according to claim 10, wherein said insert consists of a metal with high electric resistivity.

14. The improvement according to claim 13, wherein the insert is selected from the group consisting of chromium and chromium-copper.

15. The improvement according to claim 10 and further including an electrically insulating intermediate layer disposed between said insert and at least one surface of said annular recess.

16. The improvement according to claim 10, and further including an intermediate layer of electrically insulating material on the surface of said insert.

17. The improvement according to claim 16, wherein said insert comprises a metallic ring with an at least partially oxidized surface.

18. The improvement according to claim 1, wherein said zone is disposed in said contact ring with the material of the contact ring consisting of at least one supplemental material increasing the electric resistance in said zone.

19. The improvement according to claim 18, wherein said supplemental material is selected from the group consisting of tin, bismuth, phosphorous, arsenic and several of these materials.

20. The improvement according to claim 1 wherein said contact ring consists of a chromium-copper matrix, and said contact carrier of copper.

21. The improvement according to claim 1 wherein the electric conductivity of said contact ring is substantially lower than the conductivity of said contact carrier.

22. The improvement according to claim 21, wherein said contact ring contains up to 15% iron or up to 20% cobalt or iron and cobalt.

* * * * *